US006796644B1

(12) United States Patent
Anderson, Jr. et al.

(10) Patent No.: US 6,796,644 B1
(45) **Date of Patent: *Sep. 28, 2004**

(54) INK SOURCE REGULATOR FOR AN INKJET PRINTER

(75) Inventors: James D. Anderson, Jr., Harrodsburg, KY (US); Gerald F. Davis, Lexington, KY (US); John R. Fowler, Nicholasville, KY (US); David E. Greer, Lexington, KY (US); Trevor D. Gray, Midway, KY (US); Timothy L. Howard, Lexington, KY (US); Steven R. Komplin, Lexington, KY (US); Matthew J. Russell, Stamping Ground, KY (US); David T. Shadwick, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/465,403

(22) Filed: Jun. 18, 2003

(51) Int. Cl.[7] ..... B41J 2/175
(52) U.S. Cl. ..... 347/85
(58) Field of Search ..... 347/54, 85, 86, 347/87

(56) References Cited

U.S. PATENT DOCUMENTS

| | | | | |
|---|---|---|---|---|
| 3,940,773 | A | 2/1976 | Mizoguchi et al. | 347/68 |
| 4,303,929 | A | 12/1981 | Blanck | 347/86 |
| 4,336,544 | A | 6/1982 | Donald et al. | 347/54 |
| 4,380,018 | A | 4/1983 | Andoh et al. | 347/68 |
| 4,462,428 | A | 7/1984 | Guenther et al. | 137/868 |
| 4,480,259 | A | 10/1984 | Kruger et al. | 347/63 |
| 4,604,633 | A | 8/1986 | Kimura et al. | 347/7 |
| 4,641,154 | A | 2/1987 | Mikalsen | 347/88 |
| 4,685,185 | A | 8/1987 | Boso et al. | 29/890.1 |
| 4,734,706 | A | 3/1988 | Le et al. | 347/71 |
| 4,734,711 | A | 3/1988 | Piatt et al. | 347/17 |
| 4,860,787 | A | 8/1989 | Grosselin | 137/487.5 |
| 4,910,529 | A | 3/1990 | Regnault | 347/6 |
| 4,914,453 | A | 4/1990 | Kanayama et al. | 347/86 |
| 5,040,002 | A | 8/1991 | Pollacek et al. | 347/87 |
| 5,126,755 | A | 6/1992 | Sharpe et al. | 347/54 |
| 5,426,459 | A | 6/1995 | Kaplinsky | 399/320 |
| 5,440,333 | A | 8/1995 | Sykora et al. | 347/87 |
| 5,451,995 | A | 9/1995 | Swanson et al. | 347/87 |
| 5,541,632 | A | 7/1996 | Khodapanah et al. | 347/87 |
| 5,574,490 | A | 11/1996 | Gragg et al. | 347/87 |
| 5,583,545 | A | 12/1996 | Pawlowski, Jr. et al. | 347/7 |

(List continued on next page.)

*Primary Examiner*—Anh T. N. Vo
(74) *Attorney, Agent, or Firm*—Taft, Stettinius & Hollister, LL

(57) ABSTRACT

A regulator adapted to regulate the throughput of an ink between an ink source and a print head includes: (a) a pressurized chamber including an ink inlet in fluid communication with and ink source, an ink outlet in fluid communication with a print head, and at least one flexible wall; and (b) a lever including a flexible arm extending along a portion of the flexible wall and an opposing arm operatively coupled to a seal biased to close the ink inlet when the lever is in a first position and to open the ink inlet to allow fluid communication between the ink inlet and the pressurized chamber when the lever is pivoted to a second position; where a lower pressure differential across the flexible wall causes the flexible wall to actuate the flexible arm, pivoting the lever to the first position (inlet closed), where a higher pressure differential across the flexible wall causes the flexible wall to actuate the flexible arm to pivot the lever to the second position (inlet open), and where a pressure change from the lower pressure differential to the higher pressure differential across the flexible wall causes the flexible wall to actuate and flex the flexible arm without causing the lever to pivot.

64 Claims, 12 Drawing Sheets

U.S. PATENT DOCUMENTS 5,594,483 A 1/1997 Kaplinsky et al. ..... 347/87
5,610,643 A 3/1997 Kutami et al. ..... 347/54
5,644,341 A 7/1997 Fujii et al. ..... 347/11
5,646,666 A 7/1997 Cowger et al. ..... 347/87
5,650,811 A 7/1997 Seccombe et al. ..... 347/85
5,666,414 A 9/1997 Micali ..... 347/54
5,719,609 A 2/1998 Hauck et al. ..... 347/85
5,736,992 A 4/1998 Pawlowski, Jr. ..... 347/7
5,737,001 A 4/1998 Taylor ..... 347/85
5,745,137 A 4/1998 Scheffelin et al. ..... 347/85
5,751,319 A 5/1998 Robertson et al. ..... 347/85
5,757,401 A 5/1998 Abe et al. ..... 347/48
5,757,406 A 5/1998 Kaplinsky et al. ..... 347/87
5,771,053 A 6/1998 Merrill ..... 347/86
5,777,647 A 7/1998 Pawlowski, Jr. et al. ..... 347/86
5,781,213 A 7/1998 Ujita et al. ..... 347/86
5,812,163 A 9/1998 Wong ..... 347/68
5,812,168 A 9/1998 Pawlowski, Jr. et al. ..... 347/92
5,821,966 A 10/1998 Schell et al. ..... 347/86
5,825,383 A 10/1998 Abe et al. ..... 347/54
5,838,351 A 11/1998 Weber ..... 347/85
5,844,577 A 12/1998 Pawlowski, Jr. ..... 347/6
5,847,734 A 12/1998 Pawlowski, Jr. ..... 347/86
5,894,316 A 4/1999 Sakai et al. ..... 347/54
5,912,688 A 6/1999 Gragg ..... 347/86
5,923,353 A 7/1999 Boyd et al. ..... 347/85
5,975,686 A 11/1999 Hauck et al. ..... 347/85
5,980,028 A 11/1999 Seccombe ..... 347/85
5,992,986 A 11/1999 Gyotoku et al. ..... 347/85
6,000,785 A 12/1999 Sakai et al. ..... 347/54
6,007,190 A 12/1999 Murray et al. ..... 347/86
6,010,211 A 1/2000 Betschon ..... 347/86
6,074,043 A 6/2000 Ahn ..... 347/54
6,079,813 A 6/2000 Tuli ..... 347/54
6,084,617 A 7/2000 Balazer ..... 347/86
6,106,180 A 8/2000 Anderka ..... 401/145
6,130,690 A 10/2000 Ahn ..... 347/54
6,130,694 A 10/2000 Beatty ..... 347/85
6,164,744 A 12/2000 Froger et al. ..... 347/7
6,168,267 B1 1/2001 Komplin ..... 347/86
6,183,071 B1 2/2001 Sugimoto et al. ..... 347/85
6,199,977 B1 3/2001 Komplin et al.
6,203,146 B1 3/2001 Pawlowksi, Jr. et al. ..... 347/85
6,206,515 B1 3/2001 Swanson et al. ..... 347/87
6,217,153 B1 4/2001 Silverbrook ..... 347/54
6,217,157 B1 4/2001 Yoshihira et al. ..... 347/65
6,227,654 B1 5/2001 Silverbrook ..... 347/54
6,228,050 B1 5/2001 Olsen et al. ..... 604/93.01
6,243,115 B1 6/2001 Baker et al. ..... 347/85
6,247,791 B1 6/2001 Silverbrook ..... 347/54
6,250,747 B1 6/2001 Hauck ..... 347/86
6,257,699 B1 7/2001 Tracy et al. ..... 347/40
6,257,714 B1 7/2001 Seccombe ..... 347/92
6,260,961 B1 7/2001 Seu et al. ..... 347/87
6,270,204 B1 8/2001 Barrett et al. ..... 347/74
6,273,151 B1 8/2001 Kong ..... 141/18
6,290,348 B1 9/2001 Becker et al. ..... 347/87
6,312,116 B2 11/2001 Underwood et al. ..... 347/86
6,312,615 B1 11/2001 Silverbrook ..... 216/27
6,318,851 B1 11/2001 Hoen et al. ..... 347/92
6,325,354 B1 12/2001 Hoen et al. ..... 251/65
6,328,421 B1 12/2001 Kojima et al. ..... 347/46
6,331,050 B1 12/2001 Nakata et al. ..... 347/65
6,331,054 B1 12/2001 Seu et al. ..... 347/87
6,341,853 B1 1/2002 Scheffelin et al. ..... 347/87
6,364,471 B1 4/2002 Seccombe ..... 347/85
6,365,701 B1 4/2002 Hayashi et al. ..... 528/75
6,371,605 B1 4/2002 Komplin et al.
6,382,784 B2 5/2002 Pawlowski, Jr. et al. ..... 347/85
6,390,603 B1 5/2002 Silverbrook ..... 347/54
6,412,911 B1 7/2002 Hilton et al. ..... 347/49
6,416,165 B1 7/2002 Meyer et al. ..... 347/49
6,422,691 B2 7/2002 Kobayashi et al. ..... 347/86
6,428,140 B1 8/2002 Cruz-Uribe ..... 347/20
6,428,141 B1 8/2002 McElfresh et al. ..... 347/40
6,428,147 B2 8/2002 Silverbrook ..... 347/54
6,460,778 B1 10/2002 Silverbrook ..... 239/102.1
6,478,406 B1 11/2002 Silverbrook ..... 347/54
6,500,354 B1 12/2002 Lee et al. ..... 216/27
6,508,545 B2 1/2003 Dowell et al. ..... 347/85
6,527,357 B2 3/2003 Sharma et al. ..... 347/17
6,536,875 B1 3/2003 Pan ..... 347/54
2001/0006395 A1 7/2001 Pawlowski, Jr. et al. ..... 437/85
2001/0013886 A1 8/2001 Underwood et al. ..... 347/86
2001/0017641 A1 8/2001 Kobayashi et al. ..... 347/85
2001/0019347 A1 9/2001 Hauck ..... 347/86
2001/0030675 A1 10/2001 Kobayashi et al. ..... 347/86
2001/0040612 A1 11/2001 Shimizu ..... 347/86
2002/0008744 A1 1/2002 Otis et al. ..... 347/85
2002/0024573 A1 2/2002 Hoen et al. ..... 347/92
2002/0036680 A1 3/2002 Hall et al. ..... 347/85
2002/0039124 A1 4/2002 Nanjo et al. ..... 347/49
2002/0054194 A1 5/2002 Seccombe ..... 347/86
2002/0080216 A1 6/2002 Dowell et al. ..... 347/85
2002/0105567 A1 8/2002 Yamada et al. ..... 347/87
2002/0145650 A1 10/2002 Pan et al. ..... 347/85
2002/0186284 A1 12/2002 Anma et al. ..... 347/85
2002/0191061 A1 12/2002 Dowell et al. ..... 347/94
2003/0016279 A1 1/2003 Hayashi et al. ..... 347/87
2003/0052944 A1 3/2003 Scheffelin et al. ..... 347/49

INK SOURCE REGULATOR FOR AN INKJET PRINTER

BACKGROUND

1. Field of the Invention

The present invention is directed to a regulator for regulating the flow of ink from an ink source to a print head in a printer; and, more particularly, to a regulator that is relatively independent upon the inlet pressure, such that the functionality of the regulator is relatively independent of the inlet pressure of the ink source.

2. Background of the Invention

The flow of fluids through predetermined conduits has been generally been accomplished using a valve and/or a pressure source. More specifically, valves come in various shapes and sizes and include as a subset, check valves. These valves prevent the reversal of fluid flow from the direction the fluid passed by the valve. A limitation of check valves is that the volumetric flow of the fluid past the valve is controlled by the inlet side fluid pressure. If the inlet pressure is greater than the outlet pressure, the valve will open and fluid will pass by the valve; if not, the inlet fluid will be relatively stagnant and the valve will not open.

Inkjet printers must take ink from an ink source and direct the ink to the print head where the ink is selectively deposited onto a substrate to form dots comprising an image discemable by the human eye. Two general types of systems have been developed for providing the pressure source to facilitate movement of the ink from the ink source to the print head. These generally include gravitational flow system and pumping systems. Pumping systems as the title would imply create an artificial pressure differential between the ink source and the print head to pump the fluid from the ink source to the print head. Generally, these pumping systems have many moving parts and need complex flow control system operatively coupled thereto. Gravitational flow avoids many of these moving parts and complex systems.

Gravitational fluid flow is the most common way of delivering ink from an ink reservoir to a print head for eventual deposition onto a substrate, especially when the print head includes a carrier for the ink source. However, this gravitational flow may cause a problem in that excess ink is allowed to enter the print head and accumulate, being thereafter released or deposited onto an unintended substrate or onto one or more components of the inkjet printer. Thus, the issue of selective control of ink flow from a gravitational source has also relied upon the use of valves. As discussed above, a check valve has not unitarily been able to solve the problems of regulating ink flow, at least in part because the inlet pressure varies with atmospheric pressure, and when the valve is submerged, the pressure exerted by the fluid itself.

U.S. Pat. No. 6,422,693, entitled "Ink Interconnect Between Print Cartridge and Carriage", assigned to Hewlett-Packard Company, describes an internal regulator for a print cartridge that regulates the pressure of the ink chamber within the print cartridge. The regulator design includes a plurality of moving parts having many complex features. Thus, there is a need for a regulator to regulate the flow of ink from an ink source to a print head that includes fewer moving parts, that is relatively easy to manufacture and assemble, and that does not necessitate direct coupling to the atmosphere to properly function.

SUMMARY OF THE INVENTION

The invention is directed to a mechanical device providing control over the flow of a fluid from a fluid source to at least a point of accumulation. More specifically, the invention is directed to an ink flow regulator that selectively allows fluid communication between the ink source and the print head so as to supply the print head with ink, while substantially inhibiting the free flow through of print head. The invention comprises a pressurized chamber, generally exhibiting negative gauge pressure therewithin, having an ink flow inlet and an ink flow outlet. A seal is biased against the ink inlet to allow selective fluid communication between the interior of the pressurized chamber and an ink source. A flexible wall, acting as a diaphragm, is integrated with a chamber wall to selectively expand outwardly from and contract inwardly towards the interior of the chamber depending upon the relative pressure differential across the flexible wall. The pressure differential depends upon the pressure of the interior of the chamber verses the pressure on the outside of the flexible wall.

As the flexible wall contracts inwardly towards the interior of the chamber, it actuates a lever. The lever includes a sealing arm and an opposing flexible arm, and pivots on a fulcrum. The sealing arm includes the seal biased against the ink inlet, while the flexible arm is angled with respect to the sealing arm and includes a spoon-shaped aspect contacting the flexible wall. As the flexible wall continues contracting inward, the flexible arm flexes without pivoting the lever until the force of the wall against the flexible arm is sufficient to overcome the bias biasing the sealing arm against the inlet. When the force against the lever is sufficient to overcome the bias, the lever pivots about the fulcrum to release the seal at the ink inlet, thereby allowing ink to flow into the chamber until the pressure differential is reduced such that the bias again overcomes the reduced push created by the inward contraction of the flexible wall.

It is noted that the invention is not a check valve, as the operation of the regulator is independent from the inlet pressure. In other words, a check valve is dependent upon the inlet pressure, whereas this system of the present invention provides a relatively small inlet cross sectional area in relation to the size and relative forces action upon the regulator system that effectively negates any variance in inlet pressure. Thus, increasing the inlet pressure does not affect the operation of the regulator.

It is a first aspect of the present invention to provide a regulator adapted to regulate the throughput of an ink between an ink source and a print head, the regulator comprising: (a) a pressurized chamber including an ink inlet in fluid communication with the ink source, an ink outlet in fluid communication with the print head, and at least one flexible wall; and, (b) a lever including a flexible arm extending along a portion of the flexible wall and an opposing arm operatively coupled to a seal biased to close the ink inlet when the lever is in a first position and to open the ink inlet to allow fluid communication between the ink inlet and the pressurized chamber when the lever is pivoted to a second position; where a lower pressure differential across the flexible wall causes the flexible wall to actuate the flexible arm, pivoting the lever to the first position (inlet closed), where a higher pressure differential across the flexible wall causes the flexible wall to actuate the flexible arm to pivot the lever to the second position (inlet open), and where a pressure change from the lower pressure differential to the higher pressure differential across the flexible wall causes the flexible wall to actuate and flex the flexible arm without causing the lever to pivot.

In a more detailed embodiment of the first aspect, the lever includes a fulcrum positioned in-between the seal and the flexible arm. In another more detailed embodiment, the lever is located at least partly within the pressurized chamber. In yet another more detailed embodiment, the exterior flexible wall directly contacts the flexible arm. In a further detailed embodiment, the exterior flexible wall comprises a polymer film. In still a further more detailed embodiment, the exterior flexible wall is operatively mounted to the exterior of the pressurized chamber over a hole extending through a wall of the pressurized chamber. In yet a further more detailed embodiment, the pressurized chamber comprises a cap and a body. In another detailed embodiment, the ink inlet and the ink outlet spatially oppose one another. In yet another more detailed embodiment, an exterior surface of the exterior flexible wall is exposed to a fluid having a substantially constant pressure. In still a further more detailed embodiment, the lever includes a bearing pin, and the pressurized chamber includes a seat adapted to receive the bearing pin of the lever.

It is a second aspect of the present invention to provide a fluid regulator adapted to regulate the throughput of an ink between an ink source and a print head, the regulator comprising: (a) a pressurized chamber including an ink inlet in fluid communication with an ink source, an ink outlet in fluid communication with a print head, and at least one flexible wall; and, (b) a valve biased to restrict fluid communication between the ink source and the pressurized chamber, where the flexible wall actuates the valve to overcome the bias in response to a predetermined pressure differential across the flexible wall to provide fluid communication between the ink source and the pressurized chamber, where the fluid communication between the pressurized chamber and the ink source decreases the pressure differential across the flexible wall, and where the valve restricts fluid communication between the ink source and the pressurized chamber when the pressure differential across the flexible wall is less than the predetermined pressure differential.

In a more detailed embodiment of the second aspect, the valve includes a pivotable lever having an ink inlet seal operatively coupled to a first arm of the lever. In another more detailed embodiment, the pivotable lever is biased in a first direction, positioning the seal to restrict fluid communication between the ink source and the pressurized chamber, and the exterior flexible wall actuates the pivotable lever to a second direction to overcome the bias in response to a predetermined pressure differential across the exterior flexible wall, repositioning the seal to provide fluid communication between the ink source and the pressurized chamber. In yet another more detailed embodiment, a fulcrum of the lever is positioned in-between the seal and the flexible arm. In a more detailed embodiment, the exterior flexible wall directly actuates the pivotable lever. In a further detailed embodiment, the exterior flexible wall comprises a polymer film. In still a further more detailed embodiment, the exterior flexible wall is operatively mounted to the exterior of the pressurized chamber over a hole extending through a wall of the pressurized chamber. In yet a further more detailed embodiment, the pressurized chamber comprises at least two components.

It is a third aspect of the present invention to provide a print cartridge comprising: (a) an ink reservoir containing an ink supply, (b) a print head; and, (c) a regulator for regulating the flow of ink between the ink supply and the print head, where the regulator includes: (i) a pressurized chamber having an ink inlet in fluid communication with the ink supply and an ink outlet in fluid communication with the print head; (ii) an inlet seal positionable between a closed position closing the ink inlet and an open position opening the ink inlet; (iii) a bias biasing the inlet seal to the closed position; and, (iv) a pressure actuator adapted to overcome the bias and position the inlet seal to the open position when pressure differential between pressure within the pressurized chamber versus pressure outside the pressurized chamber increases to a predetermined level.

In a more detailed embodiment of the third aspect, the pressure actuator includes a lever having a first arm and an opposing second arm, the first arm being operatively coupled to the inlet seal and the second arm being operatively coupled to the diaphragm, the lever being pivotable between a first position in which the inlet seal is in the closed position and a second position in which the inlet seal is in the open position. In a further detailed embodiment, the diaphragm contracts inwardly with respect to the pressurized chamber as the pressure differential increases. In yet a further detailed embodiment, the second arm of the lever is a flexible arm. In a more detailed embodiment, the regulator is positioned within the ink reservoir such that the outer surface of the diaphragm is exposed to the interior of the ink reservoir. In another more detailed embodiment, a plurality of ink reservoirs and a respective plurality of regulators are positioned within the print cartridge.

It is a fourth aspect of the present invention to provide a method of regulating the throughput of ink from an ink source to an inkjet print head. The method includes the step of automatically actuating a valve in response to a higher pressure differential across a membrane, which separates a pressurized ink chamber and an area surrounding the pressurized chamber, where such actuation is operative at the higher pressure differential to open the valve allowing fluid communication between the ink source and the pressurized ink chamber thereby causing a subsequent decrease the pressure differential across the membrane, and operative at a resulting lower pressure differential to close the valve again so as to inhibit again fluid communication between the ink source and the ink chamber.

In a more detailed embodiment of the fourth aspect, the valve comprises a lever operatively coupled to a seal that selectively restricts fluid communication between the pressurized ink chamber and the ink source. In another more detailed embodiment, an area surrounding the pressurized chamber includes an ink reservoir that is also the ink source.

It is a fifth aspect of the present invention to provide a method of regulating the throughput of ink from an ink source to an inkjet print head. The method includes the steps of: separating a first body of ink from a second body of ink utilizing at least in part a flexible membrane; deforming the flexible membrane in response to a pressure differential between the first body of ink and second body of ink; and, opening a valve in response to the deformation of the membrane, wherein opening of the valve facilitates fluid communication between the first body of ink and the second body of ink and decreases the deformation of the membrane, thereby closing the valve.

In a more detailed embodiment of the fifth aspect, the step of opening a valve includes the step of actuating a lever operatively coupled between the valve and the flexible barrier. In a further detailed embodiment, the lever is biased to close the valve.

It is a sixth aspect of the present invention to provide an ink cartridge comprising: (a) a plurality of individual ink reservoirs maintained to inhibit commingling of the respective inks within the plurality of individual reservoirs, while at least two of the plurality of individual ink reservoirs share a common wall; and, (b) a plurality of ink regulators adapted to regulate the throughput of an ink within each of the plurality of individual reservoirs between the plurality of individual ink reservoirs and a print head outlet, each ink regulator comprising: (i) a pressurized chamber including an ink inlet adapted to provide fluid communication with an ink source, an ink outlet adapted to provide fluid communication with a print head, and at least one exterior flexible wall having an inner surface facing an interior of the pressurized chamber; and, (ii) a lever including a flexible arm extending along a portion of the exterior flexible wall and an opposing arm operatively coupled to a seal, the seal closing the ink inlet when the lever is in a first position and to opening the ink inlet to allow fluid communication between the ink inlet and the pressurized chamber when the lever is pivoted to a second position, the lever being biased to the first position, where a higher pressure differential across the exterior flexible wall causes the exterior flexible wall to apply force against the flexible arm contacting the exterior flexible wall, overcoming the bias, to thereby pivot the lever to the second position, opening the ink inlet, where a lower pressure differential across the exterior flexible wall causes the force applied by the exterior flexible wall against the flexible arm contacting the exterior flexible wall to weaken, succumbing to the bias, which pivots the lever back to the first position, closing the ink inlet and, where a pressure change from the lower pressure differential to the higher pressure differential across the exterior flexible wall causes the force applied by the exterior flexible wall to increase and flex the flexible arm without overcoming the bias.

In a more detailed embodiment of the sixth aspect, the common wall is non linear. In another detailed embodiment, at least two of the plurality of individual reservoirs are separated by at least one common interior wall that is staggered. In still a further detailed embodiment, the ink cartridge is operatively coupled to a print head. In yet another detailed embodiment, at least one ink reservoir of the plurality of individual ink reservoirs of the ink cartridge is in fluid communication with a print head nozzle outlet.

DETAILED DESCRIPTION

Figure 1:
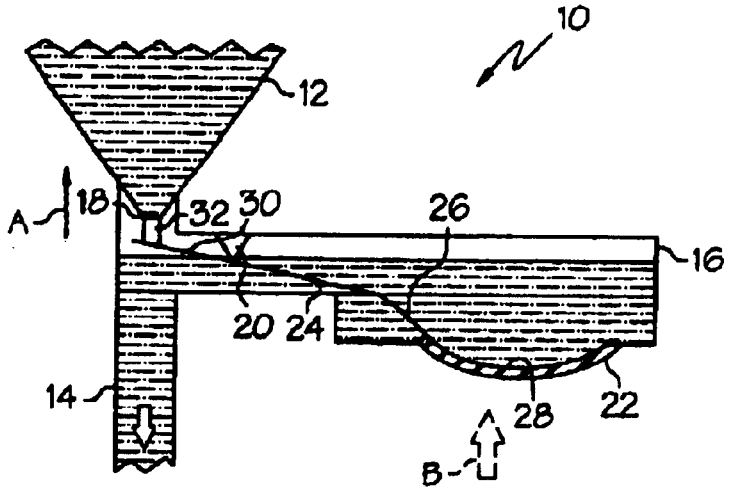
FIG. 1 is a cross-sectional, schematic, first stage representation of an exemplary embodiment of the present invention.

The exemplary embodiments of the present invention are described and illustrated below as ink regulators and/or ink cartridges (reservoirs) utilizing such regulators, for regulating the volumetric flow of ink between an ink source and a point of expulsion, generally encompassing a print head. The various orientational, positional, and reference terms used to describe the elements of the inventions are therefore used according to this frame of reference. Further, the use of letters and symbols in conjunction with reference numerals denote analogous structures and functionality of the base reference numeral. Of course, it will be apparent to those of ordinary skill in the art that the preferred embodiments may also be used in combination with one or more components to produce a functional ink cartridge for an inkjet printer. In such a case, the orientational or positional terms may be different. However, for clarity and precision, only a single orientational or positional reference will be utilized; and, therefore it will be understood that the positional and orientational terms used to describe the elements of the exemplary embodiments of the present invention are only used to describe the elements in relation to one another. For example, the regulator of the exemplary embodiments may be submerged within an ink reservoir and positioned such that the lengthwise portion is aligned vertically therein, thus effectively requiring like manipulation with respect to the orientational explanations.

Figure 2:
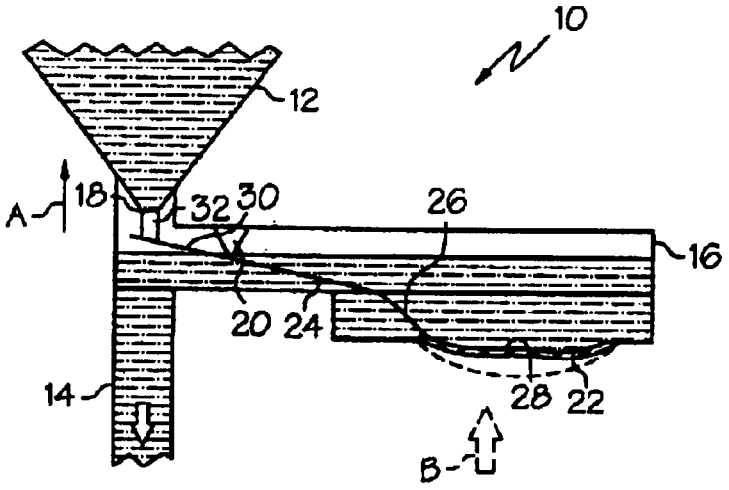
FIG. 2 is a cross-sectional, schematic, second stage representation of the exemplary embodiment of FIG. 1.
Figure 3:
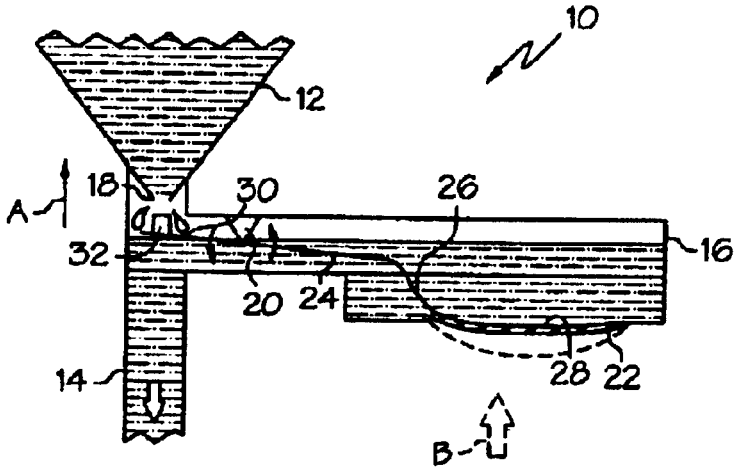
FIG. 3 is a cross-sectional, schematic, third stage representation of the exemplary embodiment of FIGS. 1 and 2.

As shown in FIGS. 1–3, an ink regulator 10 for regulating the volumetric flow of ink traveling between an ink source 12 and a print head in fluid communication with an ink outlet 14 generally includes: a pressurized chamber 16 including an ink inlet 18 in fluid communication with the ink source 12, the ink outlet 14 in fluid communication with the print head, and at least one flexible wall 22 or diaphragm; and a lever 24, pivoting on a fulcrum 20, including a flexible arm 26 having a spoon-shaped end 28 extending along a portion of the flexible wall 22 (diaphragm) and an opposing arm 30 operatively coupled to an inlet sealing member 32. The lever 24 is pivotable between a first position as shown in FIG. 1, in which the sealing member 32 presses against the ink inlet 18 to close the ink inlet, to a second position as shown in FIG. 3, in which the scaling member 32 is moved away from the ink inlet 18 to open the ink inlet and allow fluid communication between the ink inlet and the pressurized chamber 16. The lever 24 is biased (as shown by arrow A) to be in the first position, closing the ink inlet 18. The pressure within the pressurized chamber is set to be lower than that of the ambient pressure (shown by arrow B) outside of the flexible wall/diaphragm 22; and, as long as the ink inlet 18 remains closed, the pressure differential along the flexible wall will increase as ink flows through the outlet 14 to the print head. Consequently, a lower pressure differential across the flexible wall 22 causes the flexible wall 22 to expand/inflate and, thereby, pull the spoon-shaped end 28 of the flexible arm 26 contacting the flexible wall to pivot the lever 24 to the first position (closing the ink inlet in FIG. 1). Actually, the bias (represented by arrow A) causes the lever 24 to pivot when the flexible wall 22 no longer applies sufficient force against the spoon-shaped end 28 of the flexible arm to overcome the bias. A higher pressure differential across the flexible wall 22 causes the flexible wall to contract/deflate and, thereby, actuate the flexible arm contacting the flexible wall 22 so as to pivot the lever 24 to the second position (opening the ink inlet 18 as shown in FIG. 3), overcoming the bias (represented by arrow A). Also, when the pressure differential increases from the lower pressure differential to the higher pressure differential across the flexible wall 22 (resulting from ink flowing from the chamber 16 to the print head), the flexible wall 22 is caused to begin contracting/deflating and, thereby, actuate and flex the flexible arm 26 without causing the lever 24 to substantially pivot (as shown in FIG. 2).

The regulator will typically function in a cyclical process as shown in FIGS. 1–3. Referencing FIG. 1, the regulator is mounted to an ink outlet 14, such as a print head, and the inlet 18 is in fluid communication with an ink source 12. Generally, the contents of the chamber 16 will be under a lower pressure than the surrounding atmosphere (represented by Arrow B), thereby creating "back pressure" within the chamber 16. At this stage, the chamber 16 contains a certain amount of ink therein and the closed seal 32 prohibits ink from entering the chamber from the ink source 12, as the pressure differential across the flexible wall 22 is relatively low. The flexible wall 22 is in contact with the spoon-shaped end 28 of the lever's flexible arm 28. The lever is also biased (by a spring, for example) in this closed orientation.

Referencing FIG. 2, as ink continues to leave the chamber 16, the pressure within the chamber 16 begins to decrease, which, in turn, causes the pressure differential across the flexible wall 22 to increase (assuming the pressure on the outside of the flexible wall remains relatively constant). This increasing pressure differential causes the flexible wall 22 to begin to contract/deflate. Because the flexible wall 22 is in contact with the spoon-shaped end portion 28 of the lever's flexible arm 26, this contraction/deflation of the flexible wall causes the lever to flex, but not substantially pivot since the force of the flexible wall against the lever's flexible arm is not yet strong enough to overcome the bias.

Referencing FIG. 3, as ink continues to leave the chamber 16 and further increase the pressure differential across the flexible wall, the flexible wall 22 will contract/deflate to an extent that the inward pressure of the flexible wall against the flexible arm 26 of the lever overcomes the static force of the bias to pivot the lever 24 to its open position, thereby releasing the seal between the seal 32 and the ink inlet 18.

Thus, the bias and the properties of the lever enable the lever 24 to flex first, and thereafter when the amount of force applied to the lever is greater than the force applied by the spring to bias the lever closed, the lever pivots. This relatively high pressure differential between the contents of the chamber and the environment causes ink from the higher pressure ink source to pour into the chamber. The incoming volume of ink reduces the pressure differential such that the flexible wall expands outward from the chamber (inflating) to arrive again at the position as shown in FIG. 1, thus starting the three part cycle over again.

FIGS. 4–7 illustrate an exemplary embodiment of the regulator 10' for regulating volumetric flow of ink traveling between an ink source (not shown) and a print head in fluid communication with an ink outlet 14'. As introduced above, the regulator 10' includes a pressurized chamber 16' having an ink inlet 18' in fluid communication with the ink source and the ink outlet 14', which is in fluid communication with the print head (not shown). In this exemplary embodiment, the pressurized chamber 16' is formed by an injection molded base 34 having a floor 36, a pair of elongated opposing side walls 38 and a pair of elongated opposing end walls 40 which collectively form a generally rectangular top opening bounded by the four interior walls. The elongated side walls each include a pair of vertical ribs forming a bearing seat for receiving bearing pins 42 of the lever 24', thereby forming the lever's fulcrum 20'.

The floor 36 includes a generally cylindrical orifice forming the ink outlet 14' and a generally oval orifice 44 over which the flexible wall/diaphragm 22' is mounted. A pair of perpendicular, diametrical spring supports 46 (forming a cross) are positioned within the cylindrical channel of the outlet 14', where the central hub of the cross formed by the pair of diametrical supports 46 extends upwardly to form an axial projection for seating a spring 50 thereabout. Circumferentially arranges gaps 49 between the supports 46 provide fluid communication between the chamber 16' and the ink outlet 14' (see FIG. 5). The spring 50 provides the bias represented by arrow A in FIGS. 1–3.

Figure 4:
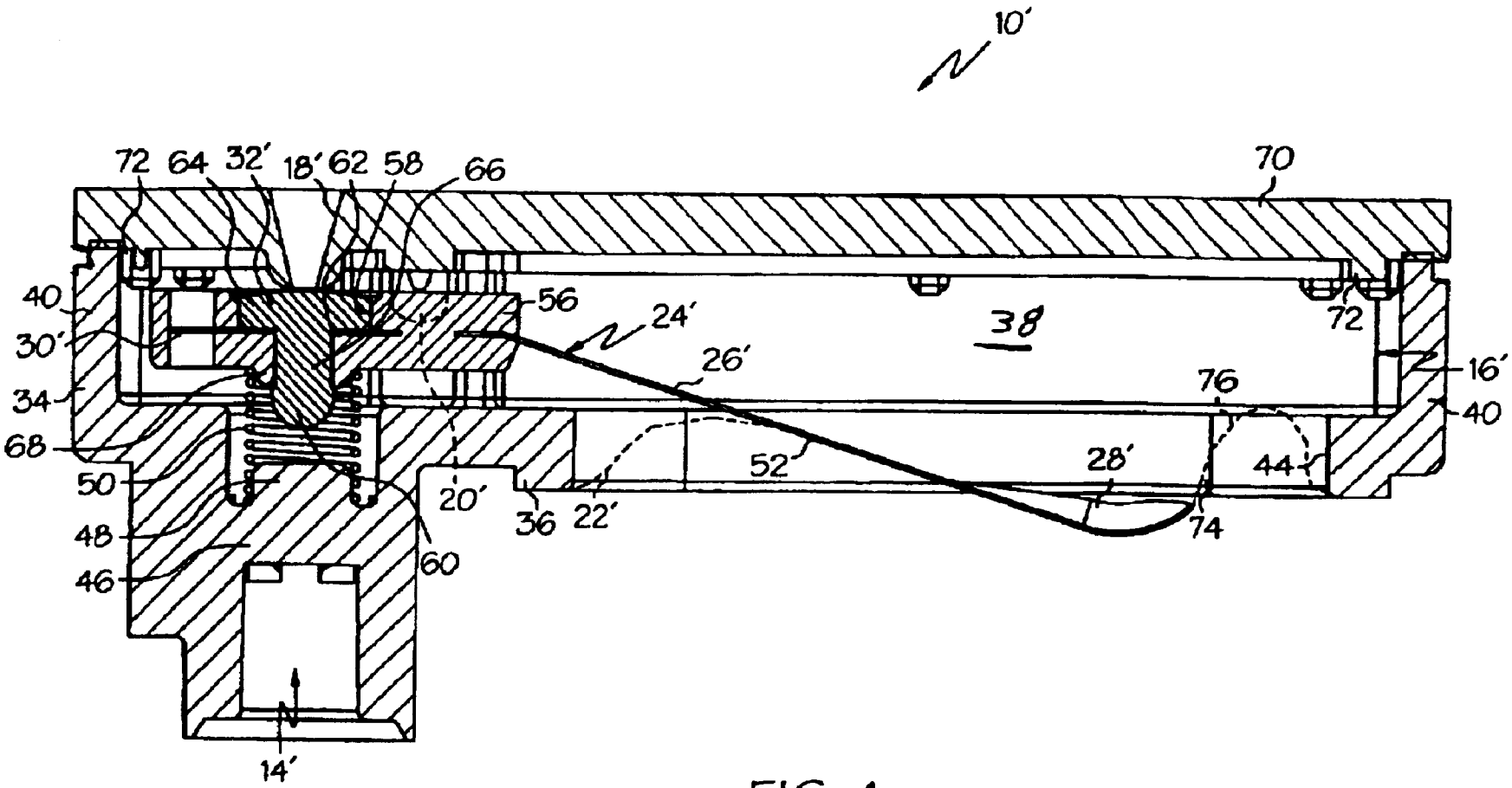
FIG. 4 is an elevational, cross-sectional view of an exemplary embodiment of the present invention.
Figure 5:
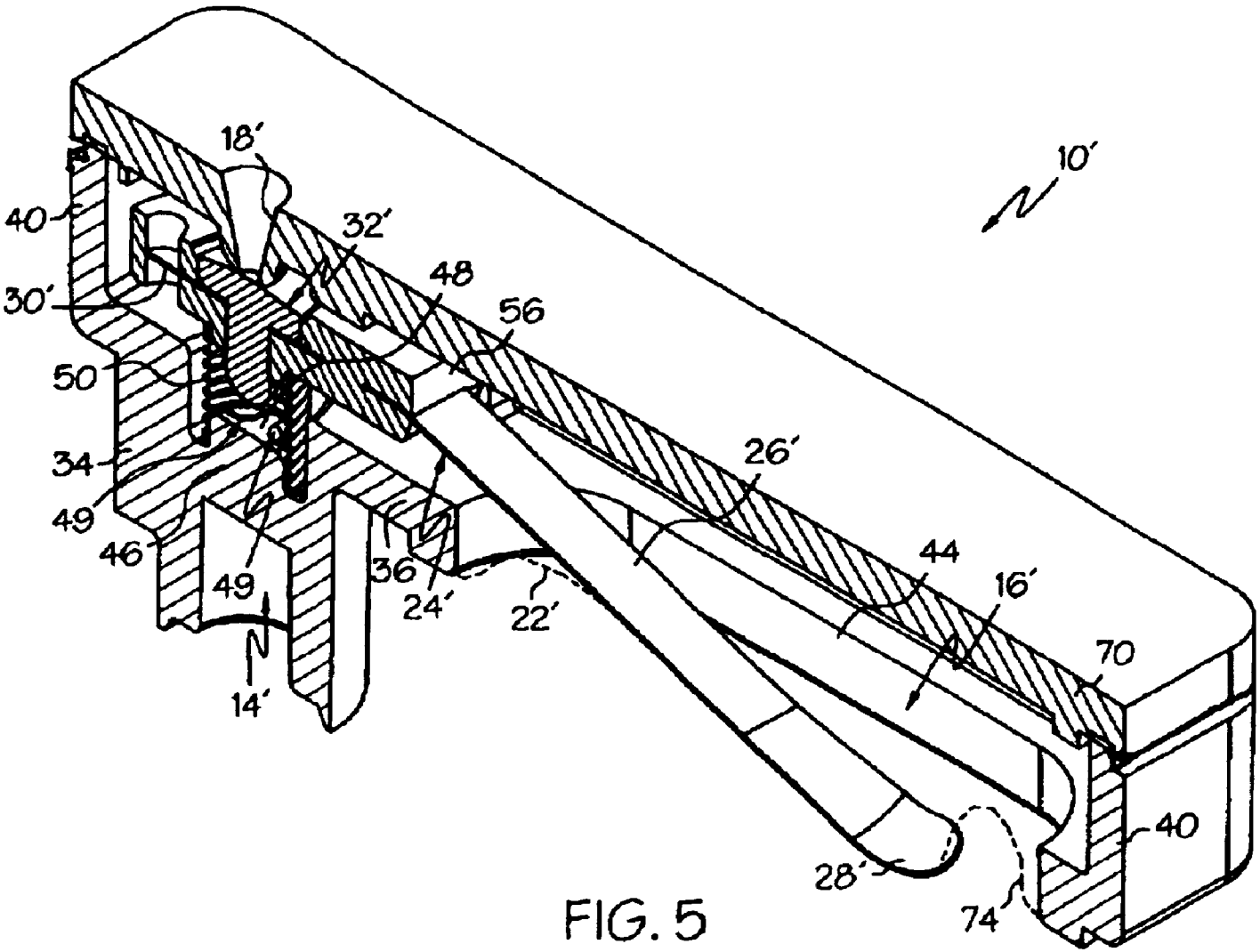
FIG. 5 is perspective, cross-sectional view of the exemplary embodiment of FIG. 4.
Figure 6:
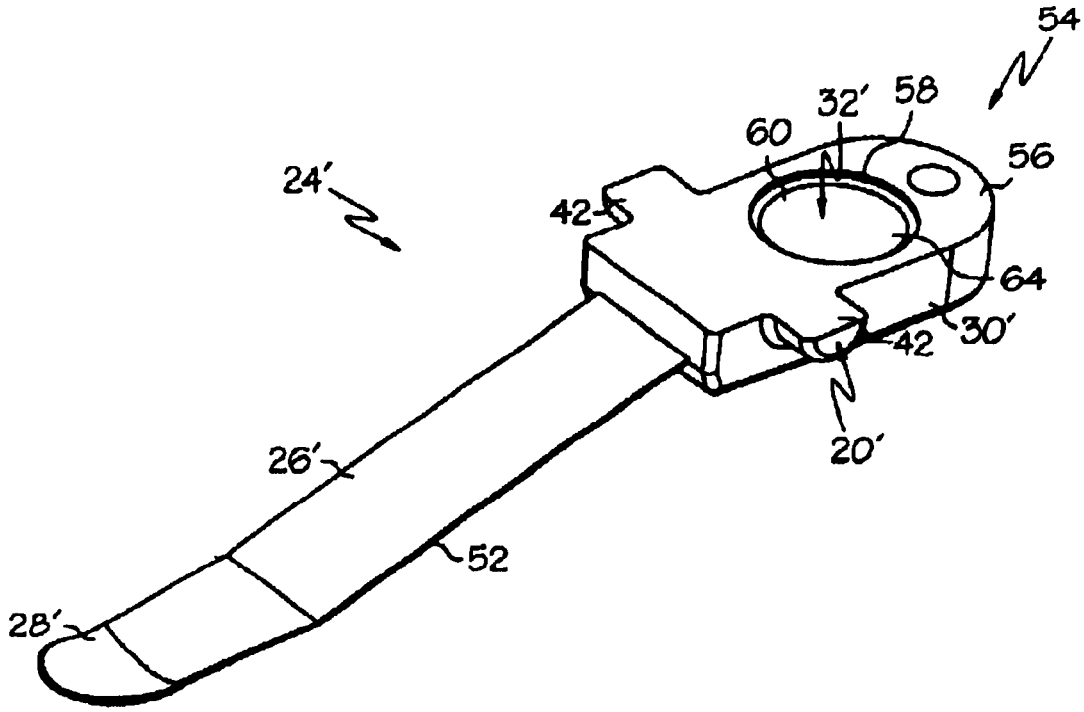
FIG. 6 is an overhead perspective view of a lever component of the embodiments of FIGS. 4 and 5.
Figure 7:
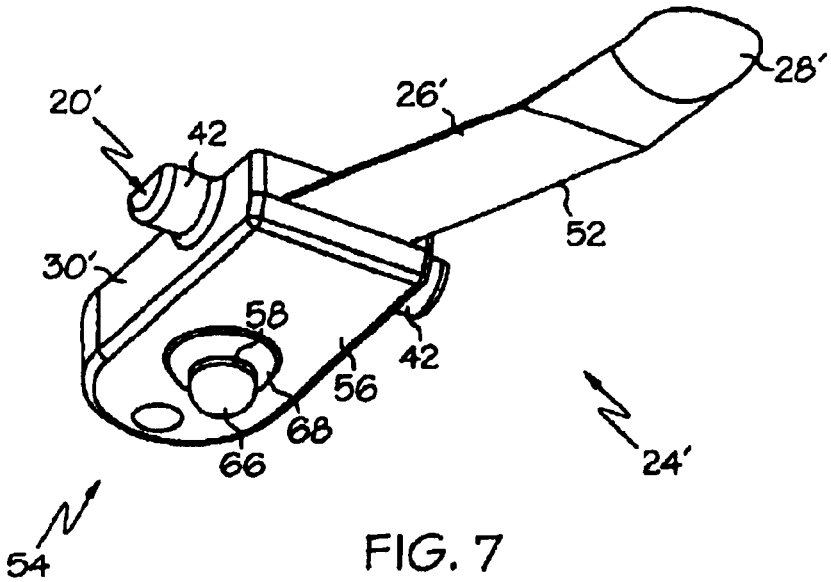
FIG. 7 is an underneath perspective view of the lever component of FIG. 6.

The lever 24' includes a strip of spring metal 52 with a spoon-shaped first end 28' and an encapsulated second end 54. The spoon-shaped end 28' is angled with respect to the encapsulated end 54. The encapsulated end 54 is encapsulated by a block 56 of plastic material where the block 56 includes the pair of bearing pins 42 extending axially outward along the pivot axis of the fulcrum 20'; and also includes a counter-bored channel 58 extending therethrough for seating an elastomeric sealing plug 60 therein. The strip 52 of spring metal also includes a hole 62 extending therethrough that is concentric with the channel 58 in the encapsulated body 56 for accommodating the sealing plug 60. The plug 60 includes a disk-shaped head 64 and an axial stem 66 extending downwardly therefrom. As can be seen in FIG. 4, the plug 60 is axially aligned with the spring 50, and the encapsulated body 56 is seated within the spring 50 by a dome-shaped, concentric projection 68 extending downwardly from the encapsulated body. The spring metal construction of the strip 52 provides the flexibility of the arm 26' described above with respect to FIGS. 1–3.

The base 34 is capped by a plastic lid 70 having a generally rectangular shape matching that of the rectangular opening formed by the elongated side walls 38 and end walls 40 of the base 34. The lid 70 has a generally planar top surface with the exception of a generally conical channel extending there through to form the inlet 18' of the pressurized chamber 16'. The lower side of the lid 70 includes a series of bases or projections 72 for registering the lid on the base 34. In an alternate embodiment, the lid may include a cylindrical tube (coupled to element 71 of FIG. 8, for example), aligned with the inlet 18' forming a hose coupling. The lid 70, of course, is mounted to the body 34 to seal the chamber 16' there within.

The flexible wall 22' is preferably a thin polymer film attached around the outer edges of the oval opening 44 extending through the floor 36 of the base 34. The area of the film 22' positioned within the opening 44 is larger than the area of the opening 44 so that the flexible film 22' can expand outwardly and contract inwardly with the changes of the pressure differential between the pressurized chamber 16' and the outer surface 74 of the film (where the pressure on the outer surface 74 of the film may be ambient pressure, pressure of ink within and ink reservoir, etc.).

Assembly of the regulator includes providing the base 34; positioning the spring 50 on the seat 48; positioning the pins 42 of the lever 24' within the bearing seats formed in the elongated side walls 38 of the base 34 and seating the dome 68 on the spring 50 such that the spoon-shaped end 28' of the lever contacts the inner surface 76 of the flexible wall 22'; and mounting the lid 70 thereover so as to seal the pressurized chamber 16 therein. Operation of the regulator 10' is as described above with respect to the regulator 10 of FIGS. 1–3.

Figure 8:
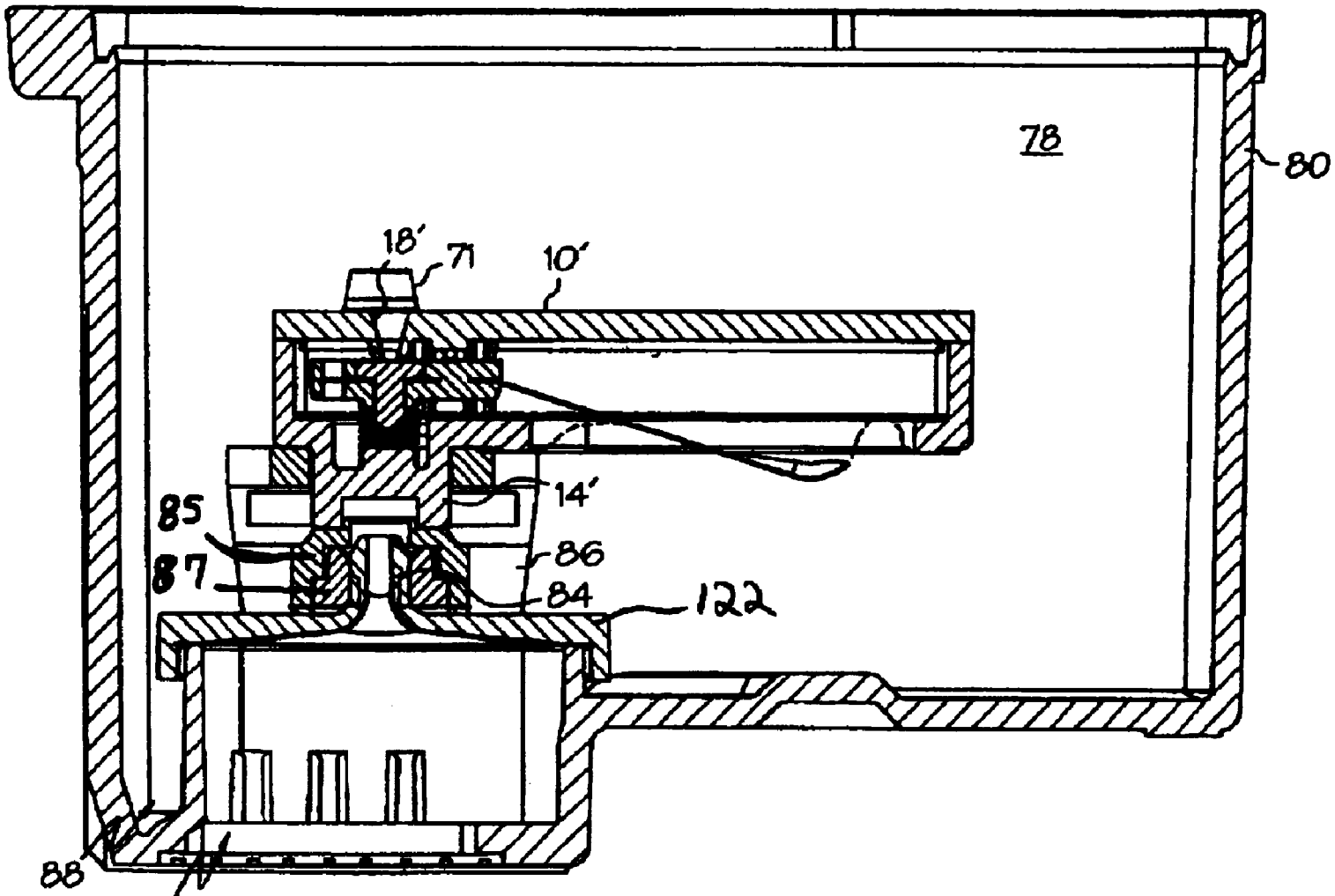
FIG. 8 is an elevational, cross-sectional view of the embodiment similar to the embodiments of FIGS. 4–7 mounted within an ink cartridge.
Figure 9:
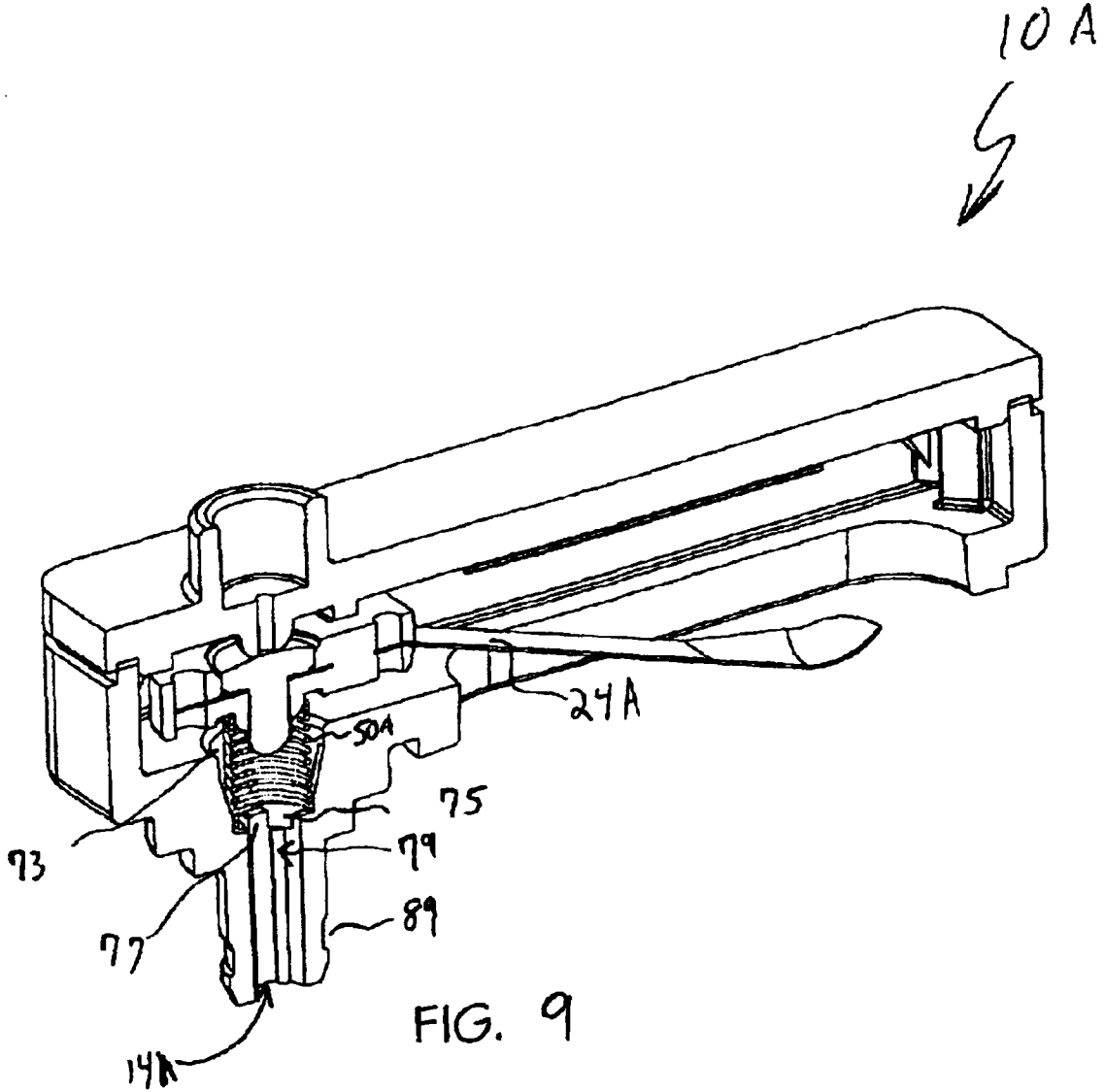
FIG. 9 is an elevated perspective, cross-sectional view of the exemplary embodiment of FIG. 10.
Figure 10:
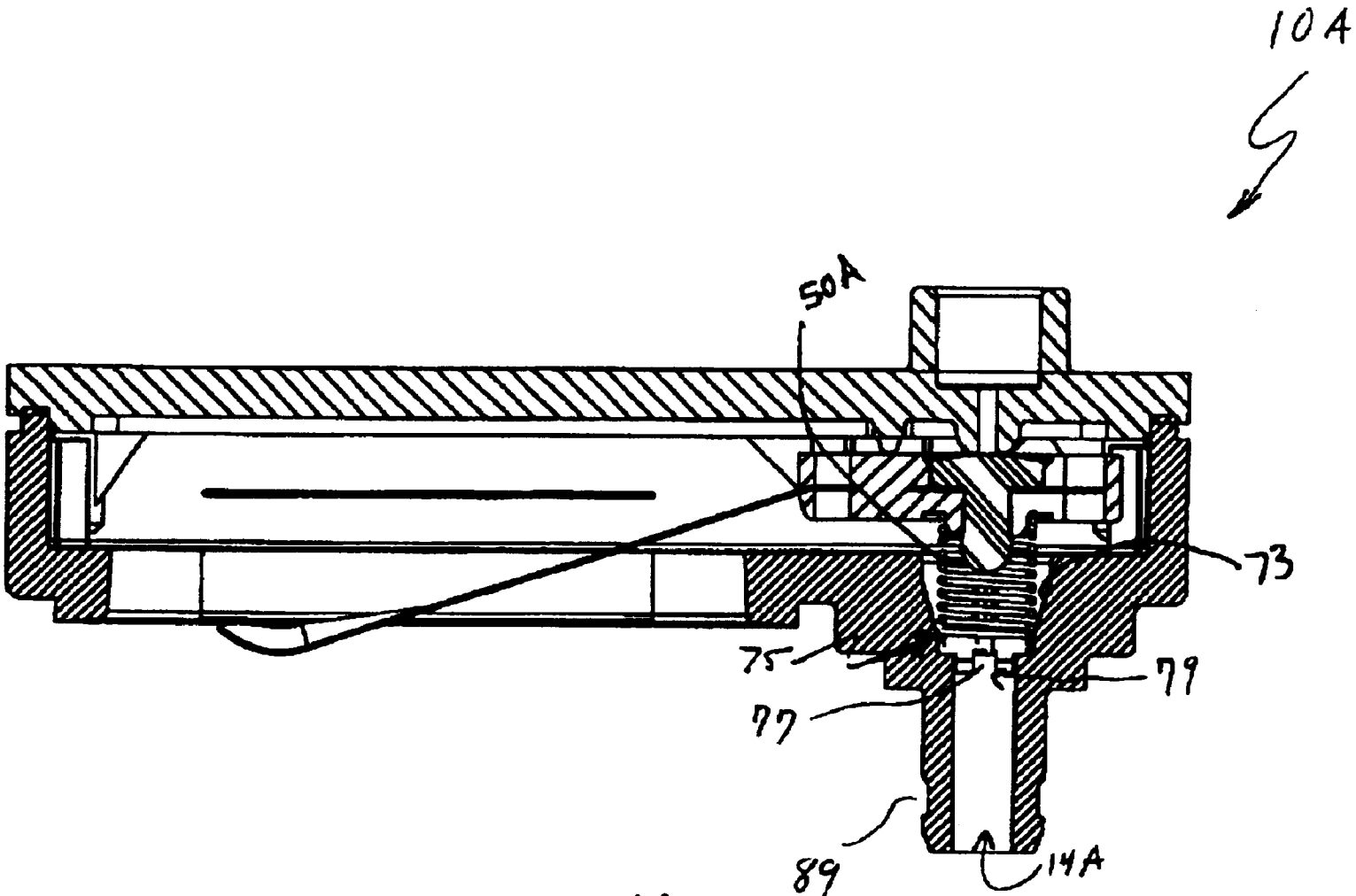
FIG. 10 is a cross-sectional view of an additional exemplary embodiment of the present invention.
Figure 11:
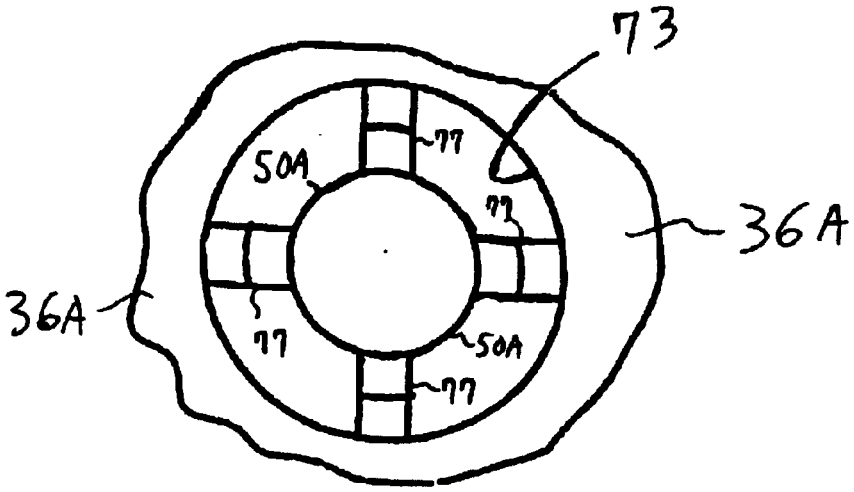
FIG. 11 is an isolated overhead view of the ink outlet of the embodiments of FIGS. 9 and 10.
Figure 12:
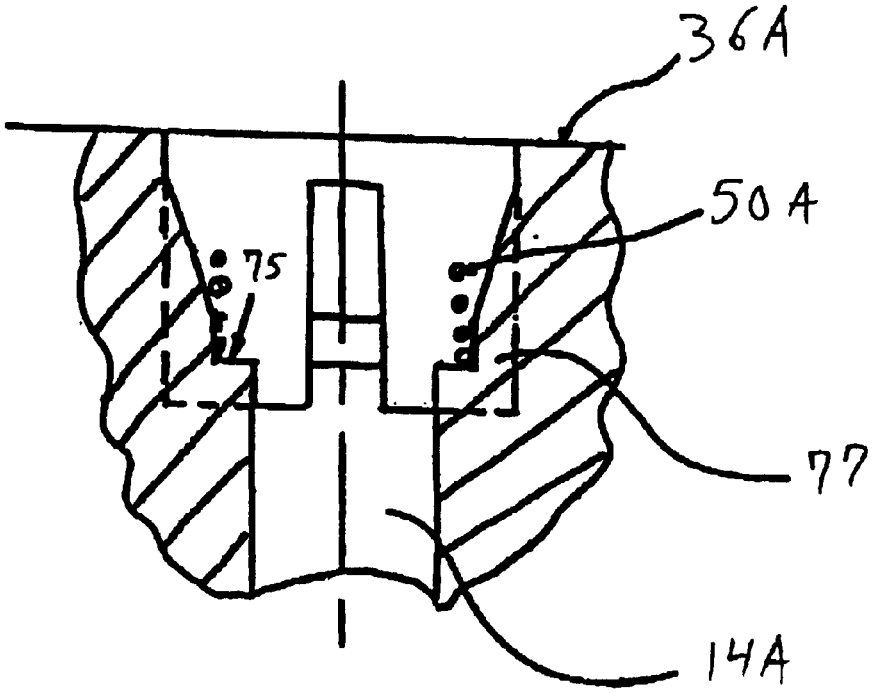
FIG. 12 is an isolated cross-sectional view of the ink outlet of the embodiments of FIGS. 9 and 10.

As shown in FIG. 8, the regulator 10' may be mounted within an ink reservoir 78 of an ink cartridge 80, having a print head 82. The outlet 14' of the regulator 10' is coupled to an inlet 84 of the ink filter cap 122 (that is operatively coupled to the print head 82) by an adapter 85. The adapter 85 is mounted to the regulator outlet 14' and circumscribes a seal 87 that provides a fluidic seal between the adapter 85 and the ink filter cap 122. An collar 86 circumscribes the adapter 85 for additional support. A siphon hose (not shown) provides fluid communication between the lowest point 88 of the reservoir 78 and the hose coupling 71, which is in fluid communication with the regulator's ink inlet 18'. In this embodiment, pressure provided against the outer surface 74 of the flexible wall 22' will be the pressure within the ink reservoir 78.

FIGS. 9–12 illustrate another exemplary embodiment of the regulator 10A for regulating the volumetric flow of ink traveling between an ink source (not shown) and a print head (not shown) in fluid communication with an ink outlet 14A. The regulator 10A includes a majority of the same structural features of the regulator 10' (See FIGS. 4 and 5) discussed above, and may utilize the same lever mechanisms as described above (See FIGS. 6 and 7). However, the regulator 10A of this exemplary embodiment includes a cylindrical opening 73 in the floor 36A in fluid communication that abuts a smaller diameter cylindrical ink outlet 14A (smaller with respect to the cylindrical opening 73), thereby allowing throughput of ink from the pressurized chamber 16A by way of the ink outlet 14A.

The cylindrical opening 73 in the floor 36A includes a spring seat 75 for seating the lower portion of the spring 50A therein. The spring seat 75 includes a plurality of protrusions extending outward from the walls of the cylindrical opening 73 that provide substantially L-shaped ribs 77 (four in this exemplary embodiment) in elevational cross-section. The vertical portion of the L-shaped ribs 77 tapers and transitions inward toward the interior walls to provide a relatively smooth transition between the rib surfaces potentially contacting the spring 50A and the interior walls of the cylindrical opening 73. The horizontal portion of the L-shaped rib 77 provides a plateau upon which the spring 50A is seated thereon. The tapered portions of the ribs 77 work in conjunction to provide a conical guide for aligning the spring 50a within the spring seat 75.

In assembling this exemplary embodiment, the tapered portion of the L-shaped ribs 77 effectively provides a conical guide for aligning the spring 50A within the spring seat 75. In other words, the L-shaped ribs 77 within the cylindrical opening 73 provides ease in assembly as the spring 50A is placed longitudinally approximate the throughput 79 and becomes gravitationally vertically aligned within the opening 73, thereby reducing the level of precision necessary to assembly this exemplary embodiment.

Figure 13:
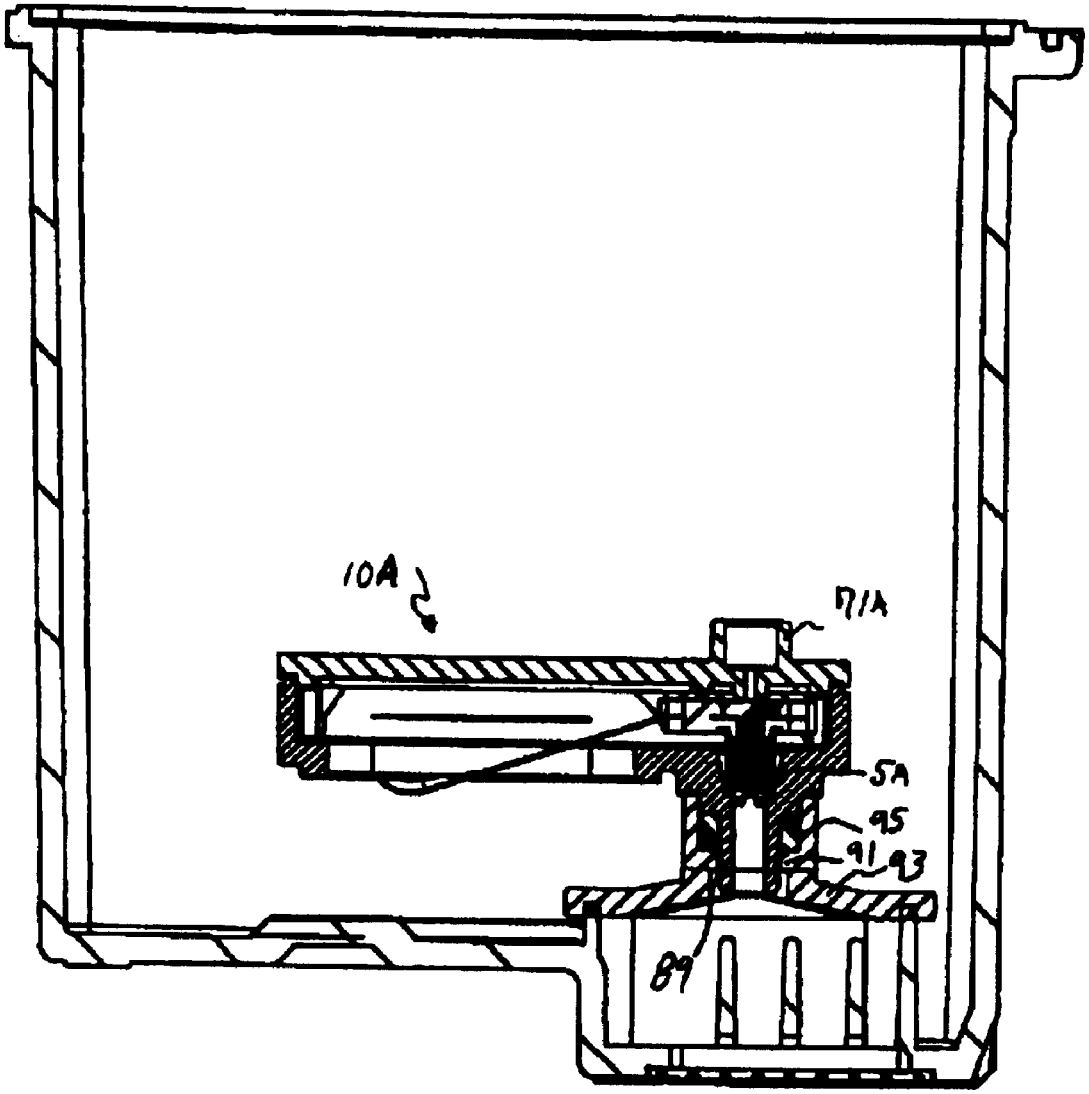
FIG. 13 is an elevational, cross-sectional view of the embodiment similar to the embodiments of FIGS. 9 and 10 mounted horizontally within an ink cartridge.
Figure 14:
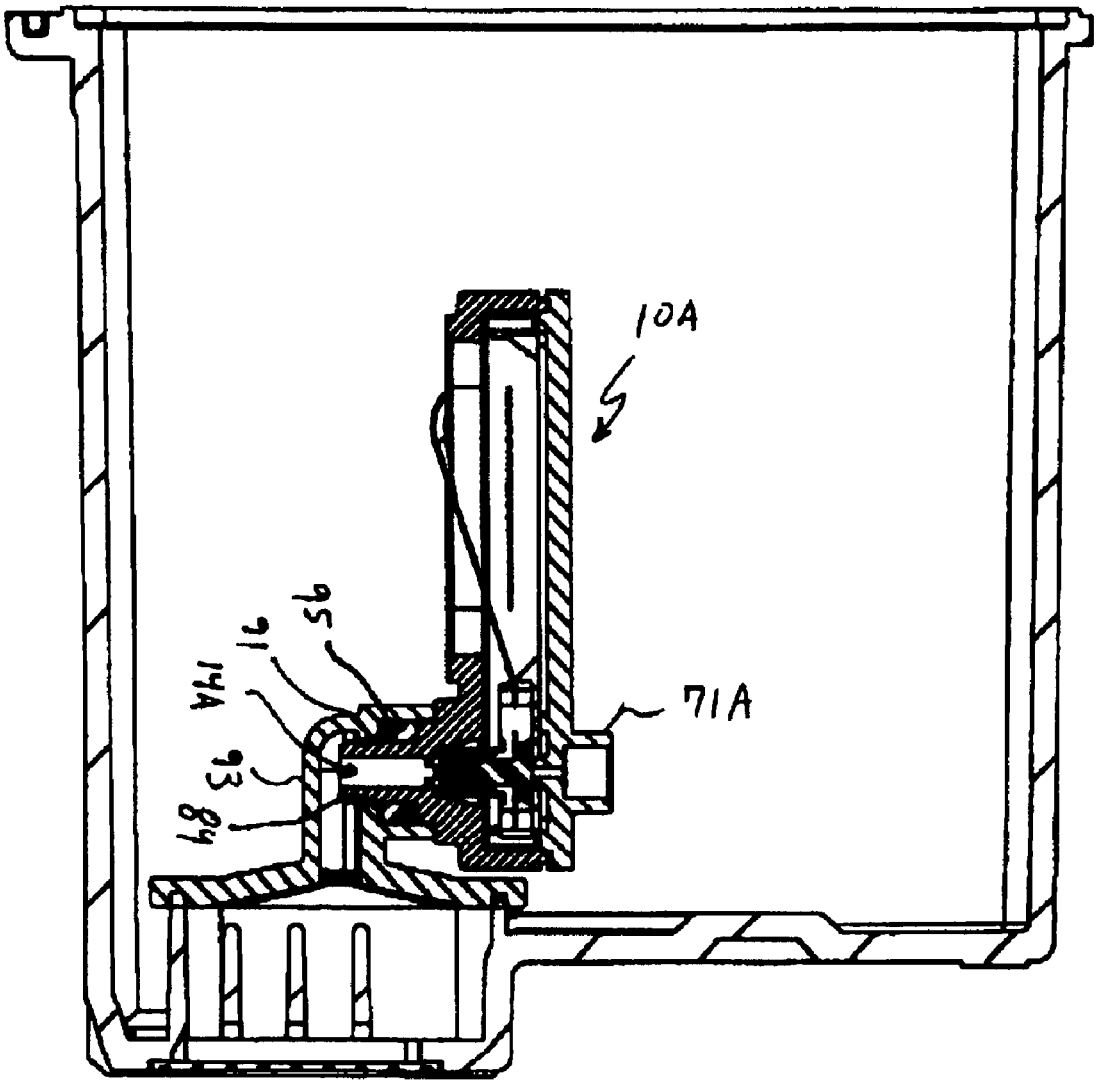
FIG. 14 is an elevational, cross-sectional view of the embodiment similar to the embodiments of FIGS. 9 and 10 mounted vertically within an ink cartridge.

As shown in FIGS. 13–14, the regulator 10A may be mounted within an ink reservoir 78A of an ink cartridge 80A operatively coupled to a print head 82A. The ink outlet 14A of the regulator 10A includes an annular groove 89 on the outer circumferential surface of the outlet stem that is adapted to mate with a corresponding annular protrusion 91 of an adapter 93 to provide a snap fit therebetween. The adapter 93 extends from, or is coupled to the inlet of the print head 82. The above-described coupling mechanism can thus be used to orient the regulator 10A in a generally vertical manner as shown in FIG. 14, or a generally horizontal manner as shown in FIG. 13. To ensure a sealed fluidic interface is provided between the outlet 14A of the regulator 10A and the adapter 93, an O-ring 95 or analogous seal is circumferentially arranged about the ink outlet 14A radially between the outlet stem and the adapter 93. Upon snapping the regulator 10A into place so that the annular groove 89 receives the protrusion 91 of the adapter 93, the O-ring 95 is compressed, resulting in a radial compression seal between the adapter 93 and the ink outlet 14A.

A siphon hose (not shown) may be operatively coupled to the ink inlet 18A to by way of the hose coupling 71A to provide fluid communication between a lower ink accumulation point 88A of the reservoir 78A and the ink inlet 18A. While the above exemplary embodiments have been described and shown where the coupling adapter 93 is integrated into, and functions concurrently as a filter cap for the print head 82, it is also within the scope and spirit of the present invention to provide an adapter that is operatively mounted in series between a filter cap of the print head 82 and the regulator 10A.

Figure 15:
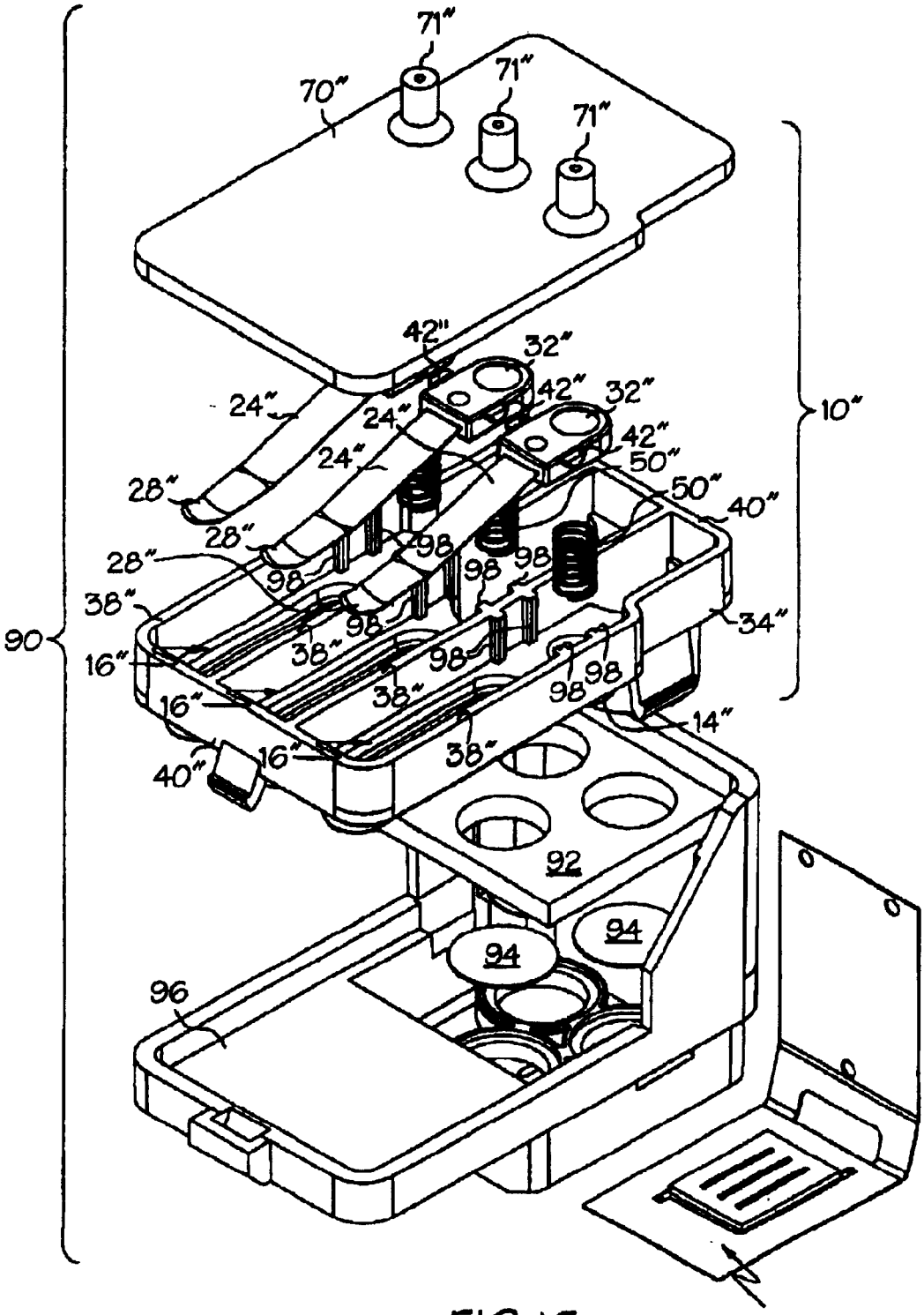
FIG. 15 is a perspective, exploded view of another embodiment of the present invention representing an ink cartridge with multiple ink reservoirs and respective ink regulators according to the present invention provided therein.

As shown in FIG. 15, another second exemplary embodiment of the present invention representing a multi-color print head assembly 90 with three ink sources (not shown) and three respective ink regulators 10" for controlling the volumetric flow of colored inks from the respective ink sources to the tri-color print head 92. Generally, a simple three-color print head will include ink sources comprising yellow colored ink, cyan colored ink, and magenta colored ink. However, it is within the scope of the present invention to provide multi-color print head assemblies having two or more ink sources, as well as single color print head assemblies. Thus, this exemplary embodiment provides a compact regulation system accommodating multi-color printing applications. For purposes of brevity, reference is had to the previous exemplary embodiments as to the general functionality of the individual regulators 10".

The print head assembly 90 includes a multi-chamber body 34", a top lid 70" having three inlet hose couplings 71" for providing fluid communication with the three ink sources, three levers 24", three springs 50", a seal 92, three filters 94, a nose 96, and the tri-color print head heater chip assembly 101. Each chamber 16" is generally analogous to the chamber described in the previous exemplary embodiments. FIG. 15 provides a view of the vertical ribs 98 provided on the elongated side walls 38", and optionally on the underneath side of the top lid 70", providing the bearing seats for the bearing pins 42" of the levers 24" as discussed above with respect to the above exemplary embodiments. Further, each chamber includes internal bearing seats, an opening accommodating inward movement of the flexible wall (not shown), and a spring guide (not shown). Likewise, each lever 24" is analogous to that described in the above exemplary embodiment.

Figure 16:
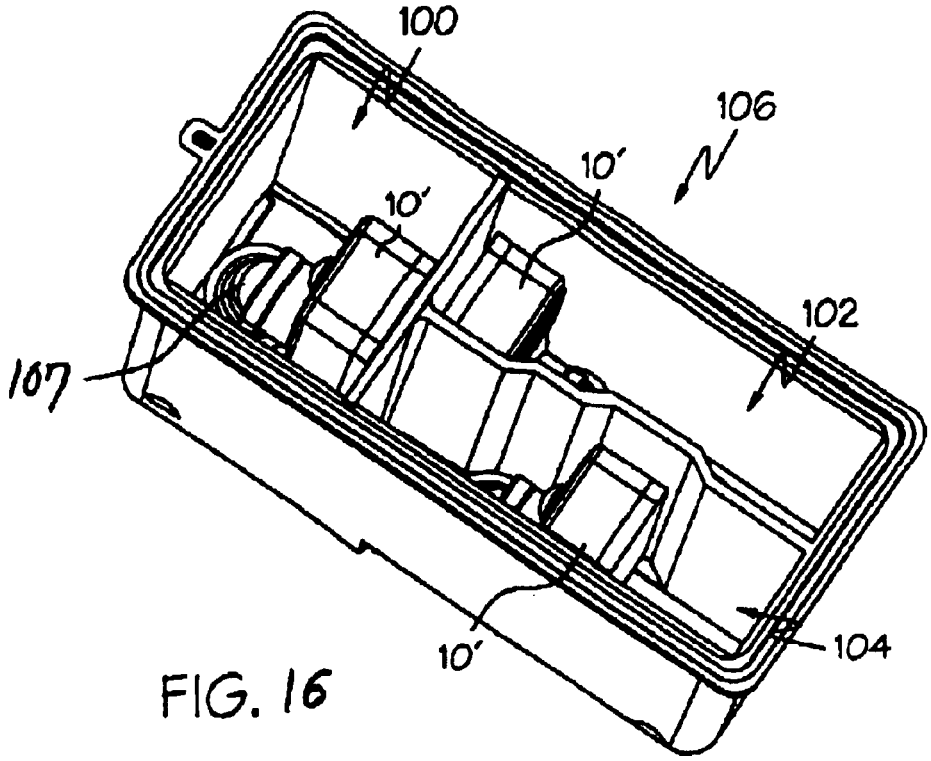
FIG. 16 is a perspective overhead view of another embodiment of the present invention representing an ink cartridge with multiple ink reservoirs and respective ink regulators according to the present invention provided therein.
Figure 17:
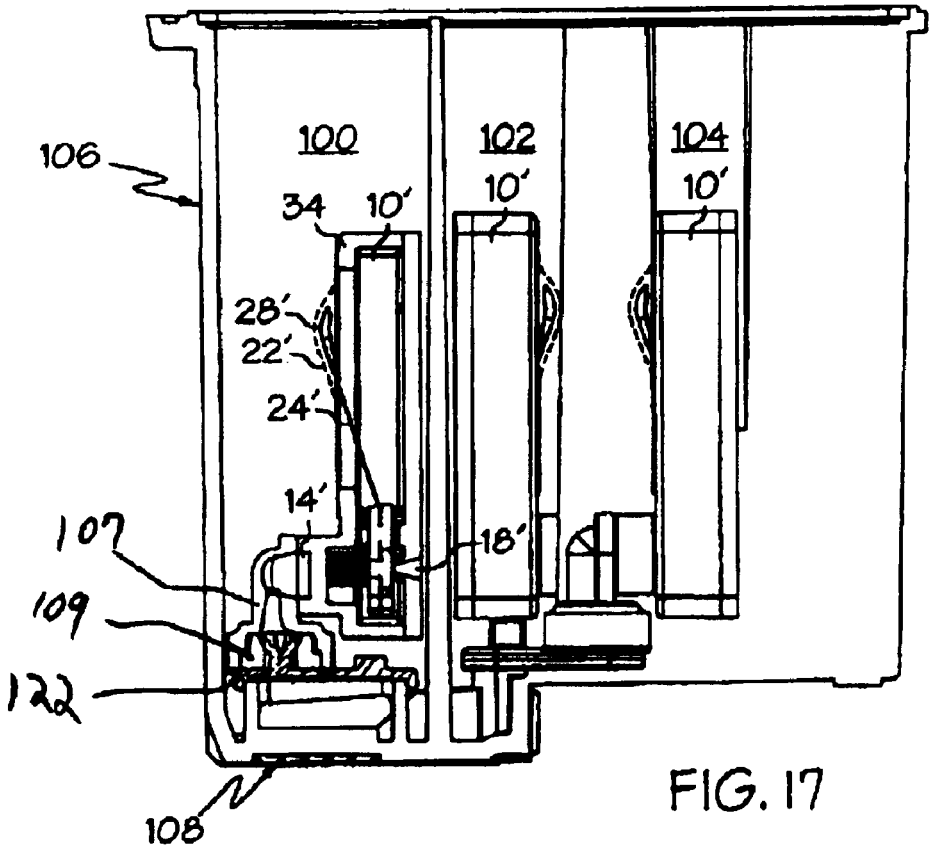
FIG. 17 is an elevational, cross-sectional view of the embodiment of FIG. 16.

Referencing FIGS. 16 and 17, three of the regulators 10' are housed within respective ink reservoirs 100, 102 and 104 contained within a multi-color printer ink cartridge 106. The regulators 10' are generally oriented in a vertical fashion with the ink inlets 18' and ink outlets 14' positioned toward the bottom of the respective reservoirs, and the spoon-shaped ends 28' of the levers 24' directed upwards. Each of the regulators 10' includes an adapter 107 that mounts the outlet 14' of the regulator to the-filter cap 122. The ink filter cap 122 is operatively coupled to the print head 108. Each adapter 107 circumscribes a seal 109 that maintains a sealed fluidic interface between the outlet 14' of the regulator and the inlet 84 of the ink filter cap 122. In such an arrangement it is possible for each of the three respective regulators to function independently of one another, and thus, the fluid level within one of the respective reservoirs has no bearing upon the functional nature of the regulators in the opposing reservoirs. It should also be noted that each of the regulators may include a siphon/hose providing fluid communication between the fluid inlet 18' and the floor of the respective fluid reservoirs, such that the lower pressure within the fluid regulator is able to draw in almost all of the fluid within a respective chamber. Each of the respective reservoirs provides an individual fluid conduit to the multi-color print head 108 while functioning independent of whether or not the respective regulator is submerged completely within ink, partially submerged within ink or completely surrounded by gas. It should also be understood that this exemplary embodiment could easily be adapted to provide two or more individual fluid reservoirs by simply isolating each respective reservoir having its own individual fluid regulator contained therein and operatively coupled to the regulator such that the ink flow from the reservoir must be in series or must go through the regulator before exiting the respective reservoir.

Following from the above description and invention summaries, it should be apparent to those of ordinary skill in the art that, while the methods and apparatuses herein described constitute exemplary embodiments of the present invention, the inventions contained herein are not limited to these precise embodiments and that changes may be made to them without departing from the scope of the inventions as defined by the claims. Additionally, it is to be understood that the invention is defined by the claims and it is not intended that any limitations or elements describing the exemplary embodiments set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A regulator adapted to regulate the throughput of an ink between an ink source and a print head, the regulator comprising:

a pressurized chamber including an ink inlet adapted to provide fluid communication with an ink source, an ink outlet adapted to provide fluid communication with a print head, and at least one exterior flexible wall having an inner surface facing an interior of the pressurized chamber; and a lever including a flexible arm extending along a portion of the exterior flexible wall and an opposing arm operatively coupled to a seal, the seal closing the ink inlet when the lever is in a first position and opening the ink inlet to allow fluid communication between the ink inlet and the pressurized chamber when the lever is pivoted to a second position, the lever being biased to the first position;

wherein a higher pressure differential across the exterior flexible wall causes the exterior flexible wall to apply a force against the flexible arm contacting the exterior flexible wall, overcoming the bias, to thereby pivot the lever to the second position, opening the ink inlet;

wherein a lower pressure differential across the exterior flexible wall causes the force applied by the exterior flexible wall against the flexible arm contacting the exterior flexible wall to weaken, succumbing to the bias, which pivots the lever back to the first position, closing the ink inlet; and wherein a pressure change from the lower pressure differential to the higher pressure differential across the exterior flexible wall causes the force applied by the exterior flexible wall to increase and flex the flexible arm without overcoming the bias.

2. The regulator of claim 1, wherein a fulcrum of the lever is positioned in-between the seal and the flexible arm.

3. The regulator of claim 1, wherein the lever is located at last partly within the pressurized chamber.

4. The regulator of claim 1, wherein the exterior flexible wall directly contacts the flexible arm.

5. The regulator of claim 1, wherein the exterior flexible wall comprises a polymer film.

6. The regulator of claim 1, wherein the exterior flexible wall is operatively mounted to the exterior of the pressurized chamber over a hole extending through a wall of the pressurized chamber.

7. The regulator of claim 1, wherein the pressurized chamber comprises a cap and a body.

8. The regulator of claim 7, wherein the cap includes the ink inlet.

9. The regulator of claim 7, wherein the body includes the ink outlet.

10. The regulator of claim 7, wherein the cap and body are mounted together by welding.

11. The regulator of claim 1, wherein the ink inlet and the ink outlet spatially oppose one another.

12. The regulator of claim 1, wherein an exterior surface of the exterior flexible wall is exposed to a fluid having a substantially constant pressure.

13. The regulator of claim 12, wherein the fluid is the atmosphere.

14. The regulator of claim 12, wherein the fluid is ink within an ink reservoir.

15. The regulator of claim 1, wherein:

the lever includes a bearing pin; and the pressurized chamber includes a seat adapted to receive the bearing pin of the lever.

16. The regulator of claim 1, wherein the lever includes a strip of spring metal.

17. The regulator of claim 16, wherein the strip of spring metal includes a first encapsulated end and an opposing second spoon-shaped end.

18. The regulator of claim 17 wherein:

the encapsulated end is encapsulated with a body of plastic material; and the body of plastic encapsulating me includes a pair of bearings forming a fulcrum of the lever and includes a cavity securing a sealing plug therein that contacts and seals against the ink inlet when the lever is in the first position.

19. A fluid regulator adapted to regulate the throughput of an ink between an ink source and a print head, the regulator comprising:

a pressurize chamber including a substantially rigid chamber housing, an ink inlet in fluid communication with an ink source, an ink outlet in fluid communication with a print head, and at least one exterior flexible wall having an inner surface facing an interior of the pressurized chamber, where the exterior flexible wall is generally taut with respect to the chamber housing; and a valve biased to restrict fluid communication between the ink source and the pressurized chamber;

wherein the exterior flexible wall actuates the valve to overcome the bias in response to a predetermined pressure differential across the exterior flexible wall to provide fluid communication between the ink source and the pressurized chamber;

wherein the fluid communication between the pressurized chamber and the ink source decreases the pressure differential across the exterior flexible wall; and wherein the valve restricts fluid communication between the ink source and the pressurized chamber when the pressure differential across the exterior flexible wall is less than the predetermined pressure differential.

20. The regulator of claim 19, wherein the valve includes a pivotable lever having an ink inlet seal operatively coupled to a first arm of the lever.

21. The regulator of claim 20, wherein:

the pivotable lever is biased in a first direction, positioning the seal to resect fluid communication between the ink source and the pressurized chamber; and the exterior flexible wall actuates the pivotable lever to a second direction to overcome the bias in response to a predetermined pressure differential across the exterior flexible wall, repositioning the seal to provide fluid communication between the ink source and the pressurized chamber.

22. The regulator of claim 20, wherein a fulcrum of the pivotable lever is positioned in-between the seal and the flexible arm.

23. The regulator of claim 20, wherein the exterior flexible wall directly actuates the pivotable lever.

24. The regulator of claim 19, wherein the exterior flexible wall comprises a polymer film.

25. The regulator of claim 19, wherein the exterior flexible wall is operatively mounted to the exterior of the pressurized chamber over a hole extending through a wall of the pressurized chamber.

26. The regulator of claim 19, wherein the pressurized chamber comprises at least two components.

27. The regulator of claim 26, wherein the at least two components are welded together.

28. The regulator of claim 26, wherein one of the at least two components includes both the ink inlet and the ink outlet.

29. The regulator of claim 26, wherein a first component includes the ink inlet and a second component includes the ink outlet.

30. The regulator of claim 20, wherein:

the pivotable lever includes a bearing pin; and the pressurized chamber includes a seat adapted to receive the bearing pin of the pivotable lever.

31. The regulator of claim 30, wherein the bearing pin is positioned in-between the seal and the flexible arm.

32. The regulator of claim 20, wherein at least a second arm opposing the first arm of the pivotable lever is flexible, thereby enabling flexation before actuation.

33. The regulator of claim 32, wherein the second arm contacts and is activated upon by the flexible wall.

34. The regulator of claim 20, wherein:

the pivotable lever includes a first encapsulated end and a second spoon-shaped end, the first encapsulated end including:

a seat securing the seal therein, at least in part, by a friction fit, and a bearing pin adapted to be received within a seat of the pressurized chamber.

35. A print cartridge comprising:

an ink reservoir containing an ink supply;

a print head; and a regulator for regulating the flow of ink between the ink supply and the print head, the regulator including:

a pressurized chamber including an ink inlet in fluid communication with the ink supply and an ink outlet in fluid communication with the print head, an inlet seal positionable between a closed position closing the ink inlet and an open position opening the ink inlet, a bias biasing the inlet seal to the closed position, and a pressure actuator adapted to overcome the bias and position the inlet seal to the open position when a pressure differential between the inside of the pressurized chamber versus the outside of the pressurized chamber increases to a predetermined level;

wherein the pressure actuator includes a floating diaphragm having an inner surface facing the inside of the pressurized chamber and an outer surface facing the outside of the pressurized chamber.

36. The print cartridge of claim 35, wherein the pressure actuator includes a lever having a first arm and an opposing second arm, the first arm being operatively coupled to the inlet seal and the second arm being operatively coupled to the diaphragm, the lever being pivotable between a first position in which the inlet seal is in the closed position and a second position in which the inlet seal is in the open position.

37. The print cartridge of claim 36, wherein the diaphragm contracts inwardly with respect to the pressurized chamber as the pressure differential increases.

38. The print cadge of claim 37, wherein the second arm of the lever is a flexible arm.

39. The print cartridge of claim 35, wherein the regulator is positioned within the ink reservoir such that the outer surface of the diaphragm is exposed to the interior of the ink reservoir.

40. The print cartridge of claim 35, further comprising a plurality of ink reservoirs and a respective plurality of regulators positioned therein.

41. A method of regulating the throughput of ink from an ink source to an inkjet print head, the method comprising the step of;

automatically actuating a valve in response to a higher pressure differential across an exterior wall of a pressurized ink chamber where such actuation is operative at the higher pressure differential to open the valve allowing fluid communication between an ink source and the pressurized ink chamber and decreasing the higher pressure differential across the exterior wall, and operative at a resulting lower pressure differential to close the valve so as to inhibit fluid communication between the ink source and the pressurized ink chamber, where a substantial portion of an exterior surface of the exterior wall is capable of being positioned in a convex orientation.

42. The method of claim 41, wherein the valve comprises a lever operatively coupled to a seal that selectively restricts fluid communication between the pressurized ink chamber and the ink source.

43. The method of claim 41, wherein an area surrounding the pressurized chamber includes an ink reservoir, which is the ink source.

44. A method of regulating the throughput of ink from an ink source to an inkjet print head, the method comprising the steps of:

separating a first body of ink from a second body of ink utilizing at least in part a flexible barrier;

deforming the flexible barrier in response to a pressure differential between the first body of ink and second body of ink; and opening a valve in response to the deformation of the barrier, wherein opening of the valve facilitates fluid communication between the first body of ink and the second body of ink and decreases the deformation of the barrier, thereafter closing the valve.

45. The method of claim 44, wherein the step of open a valve includes the step of actuating a lever operatively coupled between the valve and the flexible barrier.

46. The method of claim 45, wherein the lever is biased to close the valve.

47. An ink cartridge comprising:

a plurality of individual ink reservoirs maintained to inhibit commingling of the respective inks within the plurality of individual reservoirs, while at least two of the plurality of individual ink reservoirs share a common wall; and a plurality of ink regulators adapted to regulate the throughput of an ink within each of the plurality of individual reservoirs between the plurality of individual ink reservoirs and a print head outlet, each ink regulator comprising:

a pressurized chamber including an ink inlet adapted to provide fluid communication with an ink source, an ink outlet adapted to provide fluid communication with a print head, and at least one exterior flexible wall having an inner surface facing an interior of the pressurized chamber; and a lever including a flexible arm extending along a portion of the exterior flexible wall and an opposing arm operatively coupled to a seal, the seal closing the ink inlet when the lever is in a first position and opening the ink inlet to allow fluid communication between the ink inlet and the pressurized chamber when the lever is pivoted to a second position, the lever being biased to the first position;

wherein a higher pressure differential across the exterior flexible wall causes the exterior flexible wall to apply a force against the flexible arm contacting the exterior flexible wall, overcoming the bias, to thereby pivot the lever to the second position, opening the ink inlet;

wherein a lower pressure differential across the exterior flexible wall causes the force applied by the exterior flexible wall against the flexible arm contacting the exterior flexible wall to weaken, succumbing to the bias, which pivots the lever back to the first position, closing the ink inlet; and wherein a pressure change from the lower pressure differential to the higher pressure differential across the exterior flexible wall causes the force applied by the exterior flexible wall to increase and flex the flexible arm without overcoming the bias.

48. The ink cartridge of claim 47, wherein the common wall is non linear.

49. The ink cartridge of claim 47, wherein at least two of the plurality of individual reservoirs arc separated by at least one common interior wall that is staggered.

50. The ink cartridge of claim 47, wherein the ink cartridge is operatively coupled to a print head.

51. The ink cartridge of claim 47, wherein at least one ink reservoir of the plurality of individual ink reservoirs of the ink cartridge is in fluid communication with a print head nozzle outlet.

52. An ink regulation system comprising:

a plurality of ink regulators adapted to regulate the throughput of an ink between a plurality of individual ink reservoirs and a print head outlet, each ink regulator comprising;

a pressurized chamber including an ink inlet adapted to provide fluid communication with at least one of the plurality of ink reservoirs, an ink outlet adapted to provide fluid communication with the print head outlet, and at least one exterior flexible wall having an inner surfacing an interior of the pressurized chamber; and a lever including a flexible arm extending along a portion of the exterior flexible wall and an opposing arm operatively coupled to a seal, the seal closing the ink inlet when the lever is in a first position and to opening the ink inlet to allow fluid communication between the ink inlet and the pressurized chamber when the lever is pivoted to a second position, the lever being biased to the first position;

wherein a higher pressure differential across the exterior flexible wall causes the exterior flexible wall to apply a force against the flexible arm contacting the exterior flexible wall, overcoming the bias, to thereby pivot the lever to the second position, opening the ink inlet;

wherein a lower pressure differential across the exterior flexible wall causes the force applied by the exterior flexible wall against the flexible arm contacting the exterior flexible wall to weaken, succumbing to the bias, which pivots the lever back to the first position, closing the ink inlet; and wherein a pressure change from the lower pressure differential to the higher pressure differential across the exterior flexible wall causes the force applied by the exterior flexible wall to increase and flex the flexible arm without overcoming the bias.

53. The ink regulation system of claim 52, wherein at least two of the plurality of ink regulators include a common wall.

54. The ink regulation system of claim 52, wherein at least two of the plurality of ink regulators include at least two common walls.

55. The ink regulation system of claim 54, wherein:

a first common wall of the at least two common walls includes at least two ink inlets; and a second common wall of the at least two common walls inhibits fluid communication between the at least two ink inlets.

56. The ink regulation system of claim 52, wherein the exterior flexible wall for each of the plurality of ink regulators includes a polymer film.

57. The ink regulation system of claim 56, wherein the plurality of ink regulators include a plurality of openings adapted to have the polymer film mounted thereto, the polymer film spanning and being operatively coupled to the plurality of openings to provide each exterior flexible film for the plurality of ink regulators.

58. The ink regulation system of claim 52, wherein at least two of the plurality of ink regulators are operatively connected to at least two individual ink sources.

59. The ink regulation system of claim 58, wherein the at least two individual ink sources may be replaced by replacement ink sources.

60. The ink regulation system of claim 58, wherein the at least two individual ink sources may be refilled from replacement ink sources.

61. The ink regulation system of claim 52, wherein the plurality of ink regulators are operatively coupled to an on-carrier print head assembly.

62. The ink regulation system of claim 52, wherein:

the plurality of ink regulators are operatively coupled to an off-carrier station; and the plurality of ink regulators are in fluid communication with an on-carrier print head assembly.

63. The ink regulation system of claim 52, wherein at least two of the plurality of individual ink reservoirs are configured to be inseparable from one another.

64. The ink regulation system of claim 52, wherein at least two of the plurality of regulators are configured to be inseparable from one another.

* * * * *